US009291001B2

(12) United States Patent
King et al.

(10) Patent No.: US 9,291,001 B2
(45) Date of Patent: Mar. 22, 2016

(54) MACHINED HIGH ANGLE NOZZLE SOCKETS FOR STEEL BODY BITS

(71) Applicant: Varel International Ind., L.P., Carrollton, TX (US)

(72) Inventors: William W. King, Houston, TX (US); Steven W. Drews, Cypress, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 149 days.

(21) Appl. No.: 14/034,733

(22) Filed: Sep. 24, 2013

(65) Prior Publication Data

US 2014/0090901 A1 Apr. 3, 2014

Related U.S. Application Data

(60) Provisional application No. 61/708,982, filed on Oct. 2, 2012.

(51) Int. Cl.
*E21B 10/61* (2006.01)
*E21B 10/60* (2006.01)

(52) U.S. Cl.
CPC ..... *E21B 10/61* (2013.01); *E21B 10/602* (2013.01); *Y10T 29/49826* (2015.01)

(58) Field of Classification Search
CPC ..... E21B 10/60; E21B 10/602; E21B 10/61; E21B 2010/607
See application file for complete search history.

(56) References Cited

U.S. PATENT DOCUMENTS 1,621,921 A 3/1927 Black
1,659,327 A 2/1928 Montgomery
4,515,227 A 5/1985 Cerkovnik
5,829,539 A 11/1998 Newton et al.
5,904,213 A 5/1999 Caraway et al.
6,045,301 A 4/2000 Kammermeier et al.
6,397,959 B1 6/2002 Villarreal
8,028,765 B2 10/2011 Plazas
2009/0283325 A1* 11/2009 Plazas ..... 175/57

(Continued)

FOREIGN PATENT DOCUMENTS

GB 2047308 11/1980

OTHER PUBLICATIONS

Copenheaver, Blaine R, International Search Report and Written Opinion of the International Searching Authority for PCT/US2013/061361,Feb. 18, 2014, pp. 1-8.
Copenheaver, Blaine R, International Search Report and Written Opinion of the International Searching Authority for PCT/US2013/061341, Feb. 18, 2014, pp. 1-14.

(Continued)

*Primary Examiner* — Giovanna C Wright
*Assistant Examiner* — Kristyn Hall

(57) ABSTRACT

An apparatus that includes one or more machined high-angle sockets and method for fabricating such sockets. The apparatus includes a body, one or more blades extending outwardly from the body, and one or more high-angle nozzles machined into a portion of the blade. The body includes a bit face at one end and a plenum formed therein communicably coupled to an opening formed at an opposing end. Each blade includes a leading section, a trailing section, a face section extending from one end of the leading section to an end of the trailing section, and an inner section extending from an opposing end of the leading section to an opposing end of the trailing section. Each nozzle includes a nozzle socket cavity and a second hole intersecting with the nozzle socket cavity and extending to the plenum, which collectively form a passage extending from the plenum to the bit face.

19 Claims, 7 Drawing Sheets

(56) References Cited

U.S. PATENT DOCUMENTS

| | | | |
|---|---|---|---|
| 2010/0101864 | A1 | 4/2010 | Sindt et al. |
| 2011/0174548 | A1 | 7/2011 | Patel et al. |

OTHER PUBLICATIONS

Copenheaver, Blaine R, International Search Report and Written Opinion of the International Searching Authority for PCT/US2013/061354, Feb. 19, pp. 1-8.

* cited by examiner

MACHINED HIGH ANGLE NOZZLE SOCKETS FOR STEEL BODY BITS

RELATED APPLICATIONS

The present application is a non-provisional application of and claims priority under 35 U.S.C. §119 to U.S. Provisional Application No. 61/708,982, entitled "Machined High Angle Nozzle Sockets For Steel Body Bits" and filed on Oct. 2, 2012, the entirety of which is incorporated by reference herein.

The present application is related to U.S. Non-Provisional patent application Ser. No. 14/034,653, entitled "Blade Flow PDC Bits" and filed on Sep. 24, 2013, and U.S. Non-Provisional patent application Ser. No. 14/034,634, entitled "Flow Through Gauge For Drill Bit" and filed on Sep. 24, 2013, both of which are hereby incorporated by reference herein.

BACKGROUND

This invention relates generally to drill bits and/or other downhole tools. More particularly, this invention relates to drill bits and/or other downhole tools that include one or more high angle nozzle sockets machined therein and the methods for forming such high angle nozzle sockets.

FIG. 1 shows a perspective view of a drill bit 100 in accordance with the prior art. FIG. 2 shows a bottom plan view of the drill bit 100 in accordance with the prior art. Referring to FIGS. 1 and 2, the drill bit 100 includes a bit body 110 that is coupled to a shank 115 and is designed to rotate in a counterclockwise direction 190. The drill bit 100 is fabricated using machined steel or any other suitable material that can be machined, such as from a bar stock. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string (not shown) is positioned on its exterior surface in other exemplary embodiments. A bore 205 is formed longitudinally through the shank 115 and a plenum 210 is formed within the bit body 110. The bore 205 communicates drilling fluid from within the drill string to the plenum 210, which then communicates the drilling fluid to a drill bit face 111, on the exterior surface of the drill bit 100, via one or more nozzles 114 during drilling operations. A flowpath 215 is formed within the bit body 110 and extends from the plenum 210 to the nozzle 114. Typically, the flowpaths 215 are formed via machining and are substantially linear within the drill bit 100.

The bit body 110 includes a plurality of gauge sections 150 and a plurality of blades 130 extending from the drill bit face 111 of the bit body 110 towards the threaded connection 116, where each blade 130 extends to and terminates at a respective gauge section 150. The blade 130 and the respective gauge section 150 are formed as a single component, but are formed separately in certain drill bits 100. The drill bit face 111 is positioned at one end of the bit body 110 furthest away from the shank 115. The plurality of blades 130 form the cutting surface of the drill bit 100. One or more of these plurality of blades 130 are either coupled to the bit body 110 or are integrally formed with the bit body 110. The gauge sections 150 are positioned at an end of the bit body 110 adjacent the shank 115. The gauge section 150 includes one or more gauge cutters (not shown) in certain drill bits 100. The gauge sections 150 typically define and hold the full hole diameter of the drilled hole.

Each of the blades 130 and gauge sections 150 include a leading edge section 132, a face section 134, a trailing edge section 136, and an inner section 138. The face section 134 extends from one longitudinal end of the trailing edge section 136 to a longitudinal end of the leading edge section 132. The leading edge section 132 faces in the direction of rotation 190, while the trailing edge section 136 faces oppositely from the direction of rotation 190. The inner section 138 extends from one latitudinal end of the trailing edge section 136 to a latitudinal end of the leading edge section 132 and from the drill bit face 111 to an end of the face section 134. A junk slot 122 is formed between each consecutive blade 130, which allows for cuttings and drilling fluid to return to the surface of the wellbore (not shown) once the drilling fluid is discharged from the nozzles 114. A plurality of cutters 140 are coupled to each of the blades 130 and extend outwardly from the surface of the blades 130 to cut through earth formations when the drill bit 100 is rotated during drilling. One type of cutter 140 used within the drill bit 100 is a PDC cutter; however other types of cutters are contemplated as being used within the drill bit 100. The cutters 140 and portions of the bit body 110 deform the earth formation by scraping and/or shearing depending upon the type of drill bit 100. Although one embodiment of the drill bit has been described, other configurations of drill bit embodiments or other downhole tools, which are known to people having ordinary skill in the art, are applicable to exemplary embodiments of the present invention.

During drilling of a borehole, the drill bit 100 rotates to cut through an earth formation to form a wellbore therein. This cutting is typically performed through scraping and/or shearing action according to certain drill bits 100, but is performed through other means based upon the type of drill bit used. Drilling fluid (not shown) exits the drill bit 100 through one or more nozzles 114 and facilitates the removal of the cuttings from the borehole wall back towards the surface. As the drill bit 100 rotates and the drilling fluid with cuttings are at the bottom of the borehole, some cuttings adhere to the drill bit 100 causing inefficiencies. Thus, the nozzles 114 can facilitate removal of portions of these cuttings that are adhered to the drill bit 100.

High angle nozzles, or high angle nozzle sockets, also known as lateral jets, are known in the drill bit casting art. Multiple component casting displacements have been used historically to cast the angled or curved passage required to mate the inlet end of the fluid path adjacent the drill bit inner plenum to the nozzle socket outlet end adjacent to the bit face. In the drill bit casting art, these non-linear displacements have been used in cast tungsten carbide matrix bit manufacture and in the manufacture of stellite cast body bits. Stellite alloy is a range of cobalt-chromium alloys designed for wear resistance and may also contain tungsten or molybdenum and a small but important amount of carbon.

High angle nozzles sockets are desirable in drill bits for some applications, for example, drilling shale, where bit cleaning highly affects the performance factor of the bit. However, these high angle nozzle sockets have not been previously employed in bit bodies machined from bar stock due to the lack of a method to install the hole geometry, angled or curved, in a machining process.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

The drawings illustrate only exemplary embodiments of the invention and are therefore not to be considered limiting of its scope, as the invention may admit to other equally effective embodiments.

DETAILED DESCRIPTION OF THE INVENTION

This invention relates generally to drill bits and/or other downhole tools. More particularly, this invention relates to drill bits and/or other downhole tools that include one or more high angle nozzle sockets machined therein and the methods for forming such high angle nozzle sockets. Although the description provided below is related to a fixed cutter bit, exemplary embodiments of the invention relate to any downhole tool being fabricated by using machined steel or any other suitable material capable of being machined into a downhole tool, such as, but not limited to, steel body bits.

Figure 1:
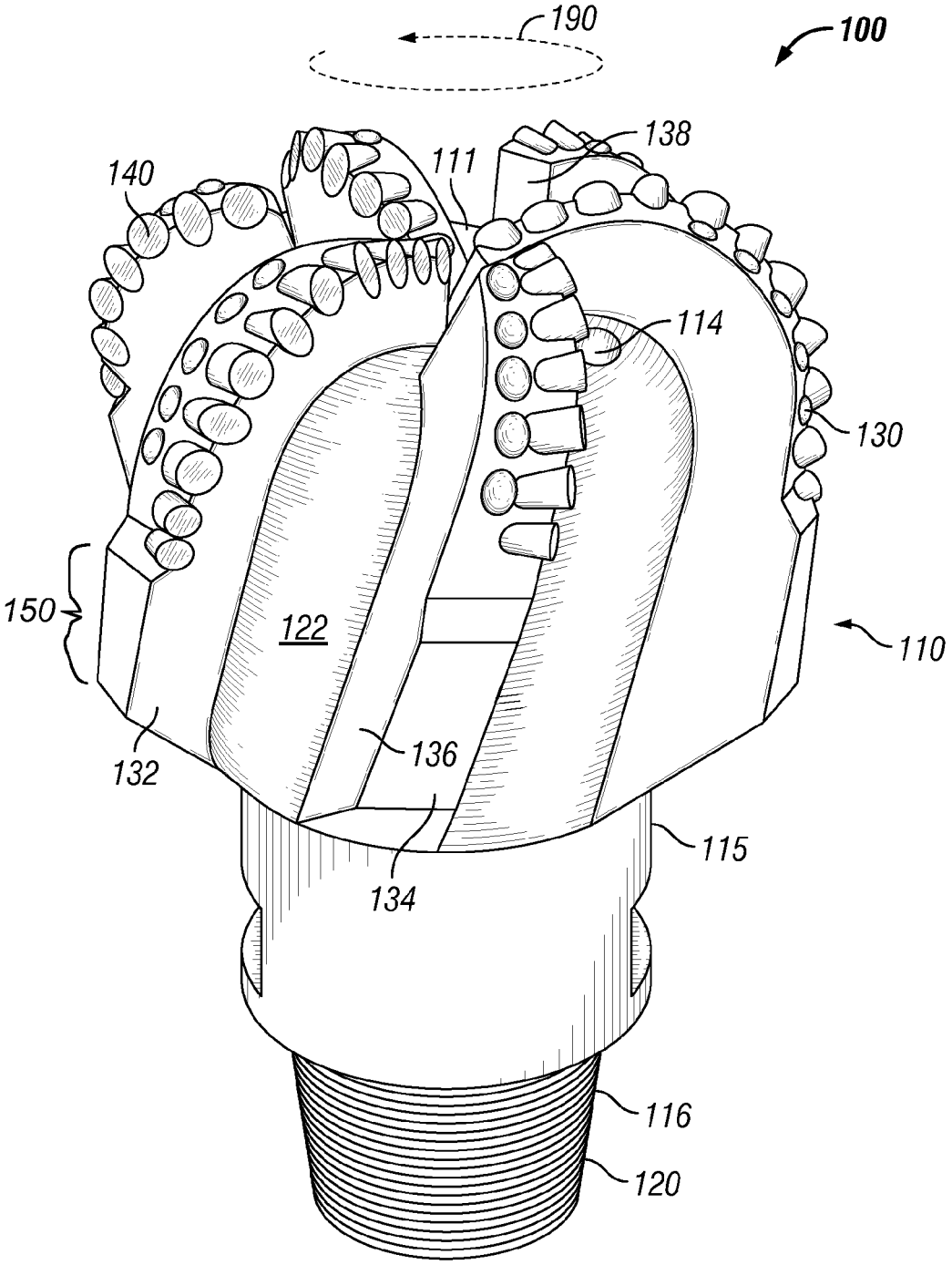
FIG. 1 (Prior Art)
FIG. 1 shows a perspective view of a drill bit in accordance with the prior art.
Figure 2:
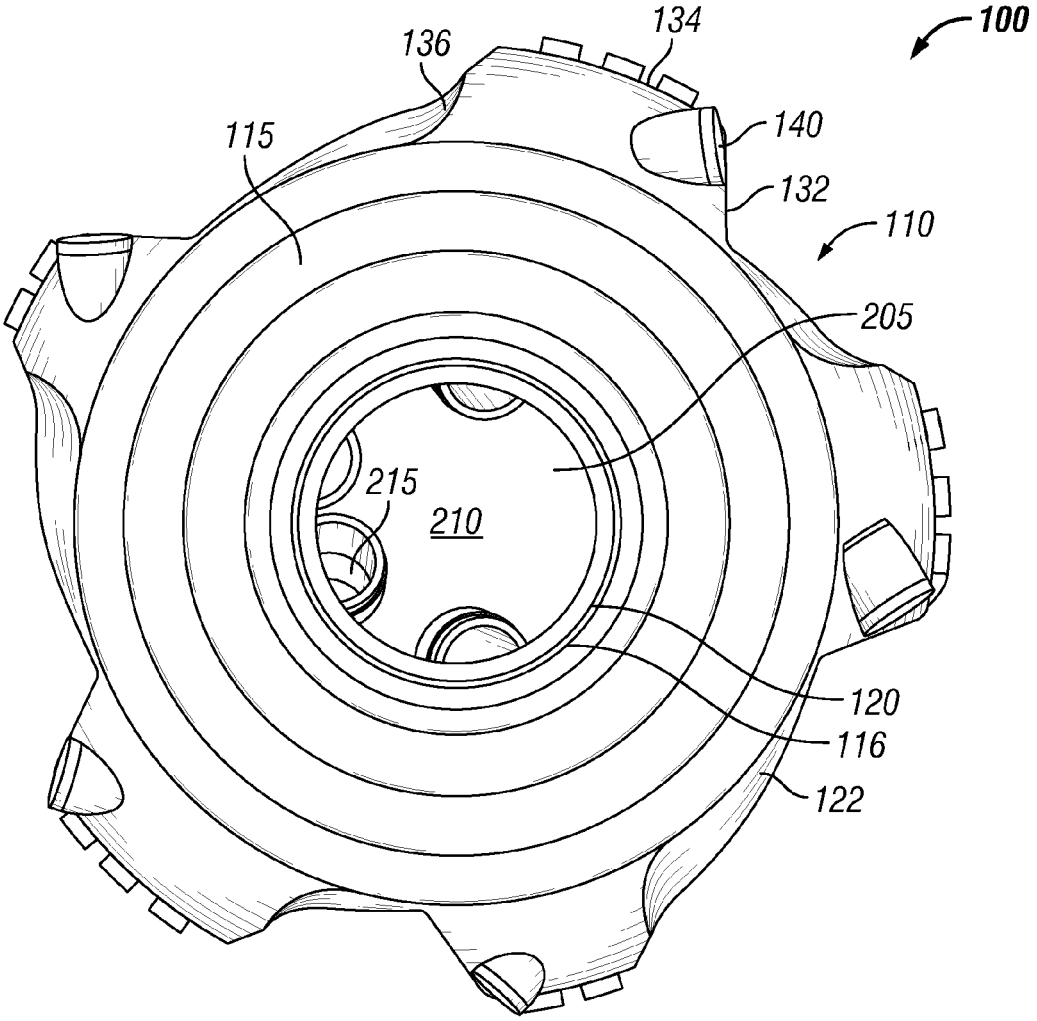
FIG. 2 (Prior Art)
FIG. 2 shows a bottom plan view of the drill bit of FIG. 1 in accordance with the prior art.
Figure 3:
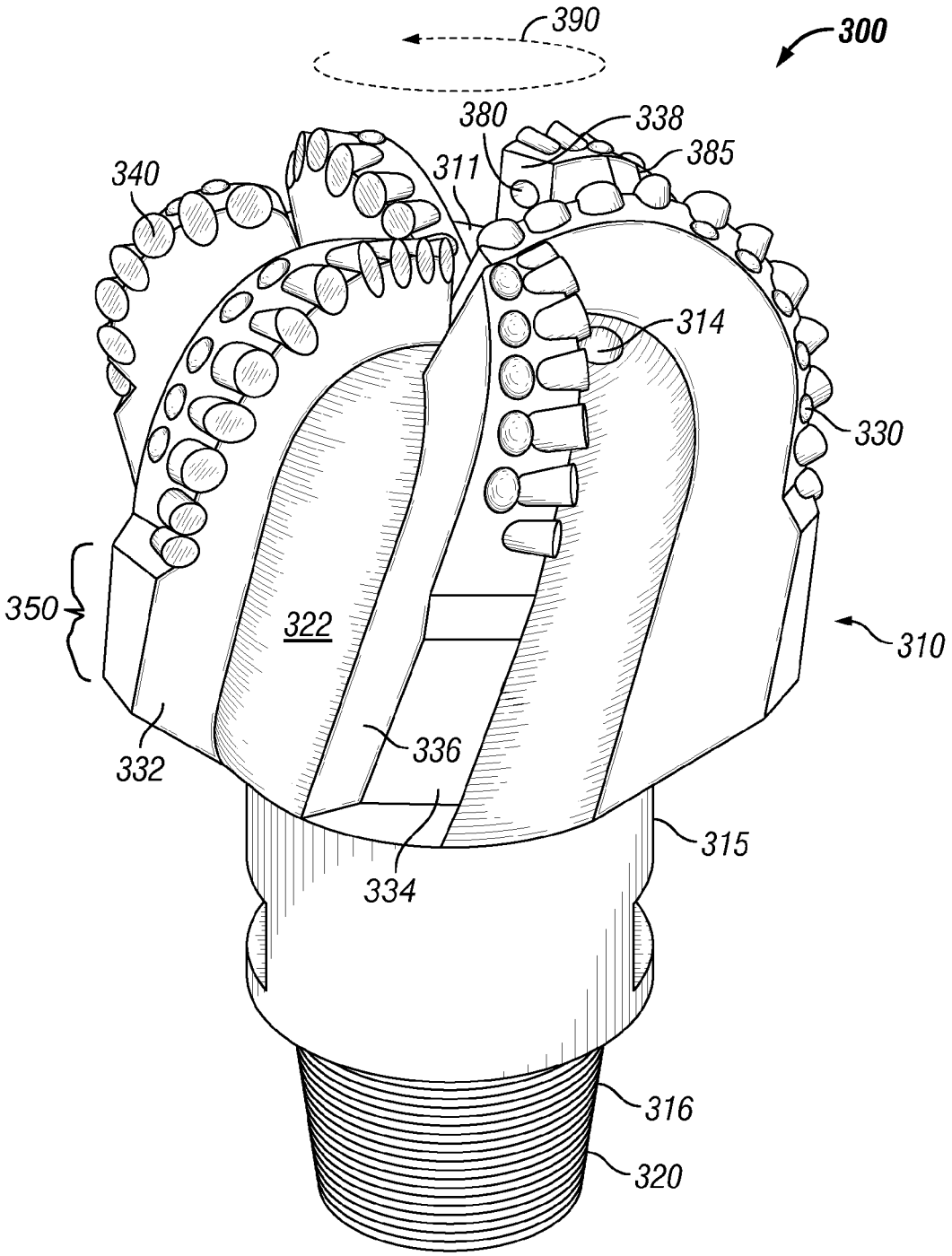
FIG. 3 shows a perspective view of a drill bit in accordance with an exemplary embodiment of the present invention.
Figure 4:
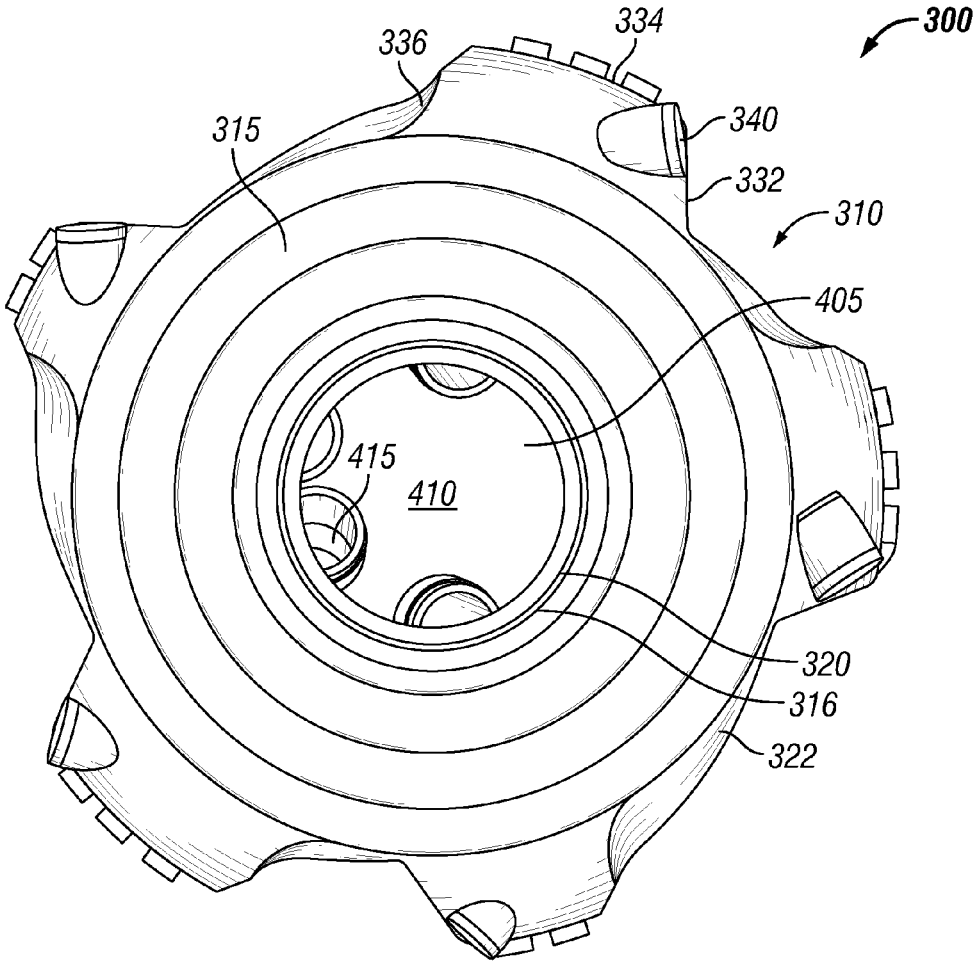
FIG. 4 shows a bottom plan view of the drill bit of FIG. 3 in accordance with an exemplary embodiment of the present invention.

FIG. 3 shows a perspective view of a drill bit 300 in accordance with an exemplary embodiment of the present invention. FIG. 4 shows a bottom plan view of the drill bit 300 in accordance with an exemplary embodiment of the present invention. Referring to FIGS. 3 and 4, the drill bit 300 includes a bit body 310 that is coupled to a shank 315 and is designed to rotate in a counter-clockwise direction 390. The drill bit 300 is fabricated using machined steel or any other suitable material that can be machined, such as from a bar stock. The shank 315 includes a threaded connection 316 at one end 320. The threaded connection 316 couples to a drill string (not shown) or some other equipment that is coupled to the drill string. The threaded connection 316 is shown to be positioned on the exterior surface of the one end 320. This positioning assumes that the drill bit 300 is coupled to a corresponding threaded connection located on the interior surface of a drill string (not shown). However, the threaded connection 316 at the one end 320 is alternatively positioned on the interior surface of the one end 320 if the corresponding threaded connection of the drill string (not shown) is positioned on its exterior surface in other exemplary embodiments. A bore 405 is formed longitudinally through the shank 315 and a plenum 410 is formed within the bit body 310. The bore 405 communicates drilling fluid from within the drill string to the plenum 410, which then communicates the drilling fluid to a drill bit face 311, on the exterior surface of the drill bit 300, via one or more nozzles 314, 380 during drilling operations. A flowpath 415 is formed within the bit body 310 and extends from the plenum 410 to the respective nozzle 314, 380. Nozzle 380 is a high angle nozzle 380. In certain exemplary embodiments the high angle nozzle 380 ranges from between about 60 degrees to about 145 degrees. In other exemplary embodiments, the high angle nozzle 380 ranges from between about 60 degrees to about 135 degrees. In yet other exemplary embodiments, the high angle nozzle ranges from between about 60 degrees to about 120 degrees. Further, in certain exemplary embodiments, the angle of the high angle nozzle 380 is in a range beyond the ranges provided above. Typically, the flowpaths 415 are formed via machining and are substantially linear within the drill bit 300 with respect to certain nozzles 314, but are non-linear within the drill bit with respect to the high angle nozzles 380. Although one high angle nozzle 380 is illustrated in drill bit 300, several high angle nozzles 380 are formed within the drill bit 300 in certain exemplary embodiments.

The bit body 310 includes a plurality of gauge sections 350 and a plurality of blades 330 extending from the drill bit face 311 of the bit body 310 towards the threaded connection 316, where each blade 330 extends to and terminates at a respective gauge section 350. The blade 330 and the respective gauge section 350 are formed as a single component, but are formed separately in certain drill bits 300. The drill bit face 311 is positioned at one end of the bit body 310 furthest away from the shank 315. The plurality of blades 330 form the cutting surface of the drill bit 300. One or more of these plurality of blades 330 are either coupled to the bit body 310, via welding or some other coupling technique know in the art, or are integrally formed with the bit body 310. The gauge sections 350 are positioned at an end of the bit body 310 adjacent the shank 315. The gauge section 350 includes one or more gauge cutters (not shown) in certain drill bits 300. The gauge sections 350 typically define and hold the full hole diameter of the drilled hole.

Each of the blades 330 and gauge sections 350 include a leading edge section 332, a face section 334, a trailing edge section 336, and an inner section 338. The face section 334 extends from one longitudinal end of the trailing edge section 336 to a longitudinal end of the leading edge section 332. The leading edge section 332 faces in the direction of rotation 390, while the trailing edge section 336 faces oppositely from the direction of rotation 390. The inner section 338 extends from one latitudinal end of the trailing edge section 336 to a latitudinal end of the leading edge section 332 and from the drill bit face 311 to an end of the face section 334. According to some exemplary embodiments, a plug 385 is coupled to a portion of the bit body 310 after the high angle nozzle 380 is formed. In certain exemplary embodiments, the plug 385, which is described in further detail below, reforms a portion of the bit body 310, such as the blade 330, after the flowpaths 415 are formed for the high angle nozzles 380. A junk slot 322 is formed between each consecutive blade 330, which allows for cuttings and drilling fluid to return to the surface of the wellbore (not shown) once the drilling fluid is discharged from the nozzles 314, 380. A plurality of cutters 340 are coupled to each of the blades 330 and extend outwardly from the surface of the blades 330 to cut through earth formations when the drill bit 300 is rotated during drilling. One type of cutter 340 used within the drill bit 300 is a PDC cutter; however other types of cutters are contemplated as being used within the drill bit 300. The cutters 340 and portions of the bit body 310 deform the earth formation by scraping and/or shearing depending upon the type of drill bit 300. Although one embodiment of the drill bit has been described, other configurations of drill bit embodiments or other downhole tools, which are known to people having ordinary skill in the art, are applicable to exemplary embodiments of the present invention.

During drilling of a borehole, the drill bit 300 rotates to cut through an earth formation to form a wellbore therein. This cutting is typically performed through scraping and/or shearing action according to certain drill bits 300, but is performed through other means based upon the type of drill bit used. Drilling fluid (not shown) exits the drill bit 300 through one or more nozzles 314, 380 and facilitates the removal of the cuttings from the borehole wall back towards the surface and/or from the surface of the drill bit 300 back towards the surface.

Figure 5:
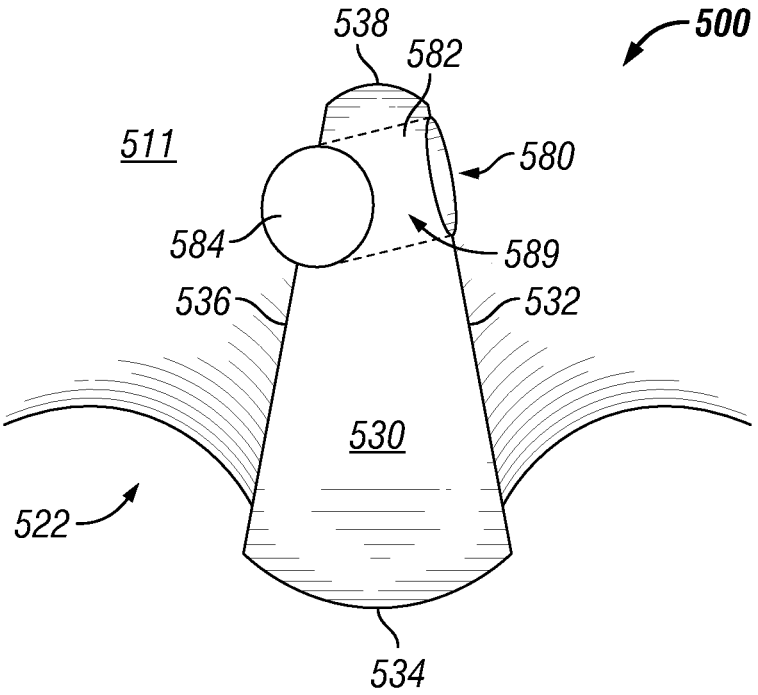
FIG. 5 shows a partial plan view of a drill bit, similar to the drill bit of FIG. 3, in accordance with another exemplary embodiment of the present invention.

FIG. 5 shows a partial plan view of a drill bit 500, similar to the drill bit 300 (FIG. 3), in accordance with another exemplary embodiment of the present invention. Referring to FIG. 5, the drill bit 500 includes a drill bit face 511, one or more blades 530 extending outwardly from the drill bit face 511, and a junk slot 522 formed between each adjacent blade 530. The drill bit face 511 and the junk slots 522 are similar to the drill bit face 311 (FIG. 3) and the junk slots 322 (FIG. 3) and therefore are not described herein for the sake of brevity. The blades 530 are similar to blades 330 (FIG. 3) except that a high angle nozzle 580, similar to high angle nozzle 380 (FIG. 3), is formed therein. Each blade 530 includes a leading edge section 532, a face section, 534, a trailing edge section 536, and an inner section 538, similar to blades 330 (FIG. 3).

The high angle nozzle 580 is formed by machining a nozzle socket cavity 582, or blind hole 582, machining a second hole 584 intersecting with the nozzle socket cavity 582, and coupling a plug 990 (FIG. 9) to the drill bit 500. The nozzle socket cavity 582 is machined at a desired high angle into the geometry of the blade 530 of a steel body bit 500, or other downhole tool fabricated from steel or other bar stock material. The nozzle socket cavity 582 is drilled into the blade 530 from the leading edge section 532 according to some exemplary embodiments. However, in alternative exemplary embodiments, the nozzle socket cavity 582 is drilled into the blade 530 from the inner section 538 and/or the trailing edge section 536. The second hole 584 of adequate diameter, which is dimensioned to carry the desired amount of drilling fluid, is drilled, or milled, through a junction of the blade 530 and the drill bit face 511, which also is referred to as a base bit body. This second hole 584 is larger in diameter than the nozzle socket cavity 582 in certain exemplary embodiment, but is the same size in other exemplary embodiments. This second hole 584 is positioned to intersect the drilled nozzle socket cavity 582 and extend into the plenum 410 (FIG. 4), thereby allowing drilling fluid to flow from the plenum 410 (FIG. 4) and out the high angle nozzle 580 via the second hole 584 and the nozzle socket cavity 582. As previously mentioned, the angle formed between the second hole 584 and the nozzle socket cavity 582 ranges from between about 60 degrees to about 145 degrees. In other exemplary embodiments, the angle formed between the second hole 584 and the nozzle socket cavity 582 ranges from between about 60 degrees to about 135 degrees. In yet other exemplary embodiments, the angle formed between the second hole 584 and the nozzle socket cavity 582 ranges from between about 60 degrees to about 120 degrees. Further, in certain exemplary embodiments, the angle formed between the second hole 584 and the nozzle socket cavity 582 is in a range beyond the ranges provided above. Further, the second hole 584 and the nozzle socket cavity 582 collectively form a flowpath 589.

Figure 6:
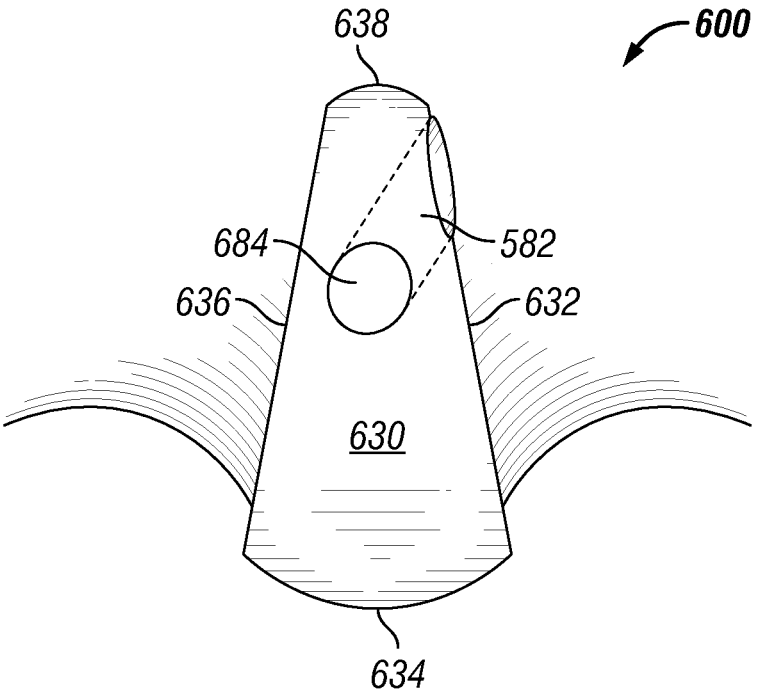
FIG. 6 shows a partial plan view of a drill bit, similar to the drill bit of FIG. 3, in accordance with another exemplary embodiment of the present invention.

In alternative exemplary embodiments, the second hole 584 is drilled, or milled, through a blade 530 or through the drill bit face 511. FIG. 6 shows a partial plan view of a drill bit 600, similar to the drill bit 500 (FIG. 5), in accordance with another exemplary embodiment of the present invention. However, the drill bit 600 includes a second hole 684 drilled, or milled, through a face section 634 of a blade 630. The blade 630 is similar to blade 530 (FIG. 5) and therefore the description is not repeated herein for the sake of brevity. The second hole 684 intersects with the nozzle socket cavity 582 and proceeds inwardly to communicate with the plenum 410 (FIG. 4). According to some exemplary embodiments, the second hole 684 is drilled, or milled, through the blade 630, from a surface that is different from which the nozzle socket cavity 582 was drilled through. For example, if the nozzle socket cavity was drilled from a leading edge section 632, the second hole 684 is drilled from any one of a face section 634, a trailing edge section 636, or an inner section 638 of the blade 630.

Figure 7:
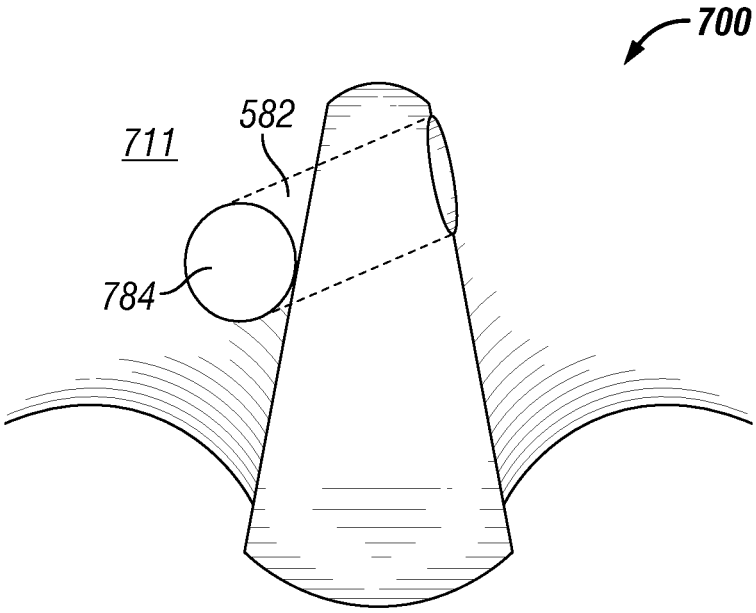
FIG. 7 shows a partial plan view of a drill bit, similar to the drill bit of FIG. 3, in accordance with a fourth exemplary embodiment of the present invention.

FIG. 7 shows a partial plan view of a drill bit 700, similar to the drill bit 500 (FIG. 5), in accordance with a fourth exemplary embodiment of the present invention. However, the drill bit 700 includes a second hole 784 drilled, or milled, through a drill bit face 711 of the drill bit 700. The drill bit face 711 is similar to drill bit face 511 (FIG. 5) and therefore the description is not repeated herein for the sake of brevity. The second hole 784 intersects with the nozzle socket cavity 582 and proceeds inwardly to communicate with the plenum 410 (FIG. 4).

Figure 8:
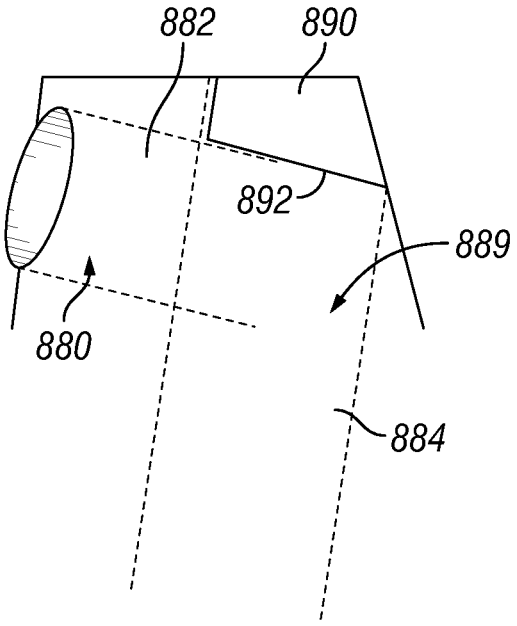
FIG. 8 shows an elevation view of a flowpath of a high angle nozzle formed within a bit body in accordance with an exemplary embodiment.

Referring to FIGS. 3-7, upon forming the second hole 584, 684, and 784 and the nozzle socket cavity 582, the plug 890, 990 (FIGS. 8 and 9, respectively) is shaped into a desired geometry and is then capped onto the drill bit 300, 500, 600, 700 over the second hole 584 684, and 784. FIG. 8 shows an elevation view of a flowpath 889 of a high angle nozzle 880 formed within a bit body 300, 500, 600, 700 in accordance with an exemplary embodiment. Referring to FIG. 8, the flowpath 889 and the high angle nozzle 880 is similar to anyone of the previously described flowpaths 589 and high angle nozzles 580. High angle nozzle 880 includes a nozzle socket cavity 882 and a second hole 884 that intersects with the nozzle socket cavity 882. The plug 890 is shaped and dimensioned to cover up at least a portion of the second hole 884. At least a portion of an inner surface 892 of the plug 890 defines a portion of the flowpath 889 that transitions between the nozzle socket cavity 882 and the second hole 884. According to some exemplary embodiments, the inner surface 892 of the plug 890 is substantially linear. However, in other exemplary embodiments, the inner surface 892 of the plug 892 is non-linear. The plug 890 is coupled to the drill bit 300, 500, 600, 700 over at least the second hole 884 using a threaded connection, welding, brazing, gluing, or some other suitable coupling mechanism, either a process or a mechanical attachment. The plug 890 is fabricated from steel, tungsten carbide, or any other suitable material. In certain exemplary embodiments, if the second hole 884 was machined through a blade, then the plug 890 is optionally further machined to add a cutter pocket or otherwise to match the geometry of the blade as desired. Hence, the desired geometry of the blade and/or facial geometry of the bit is maintained.

Figure 9:
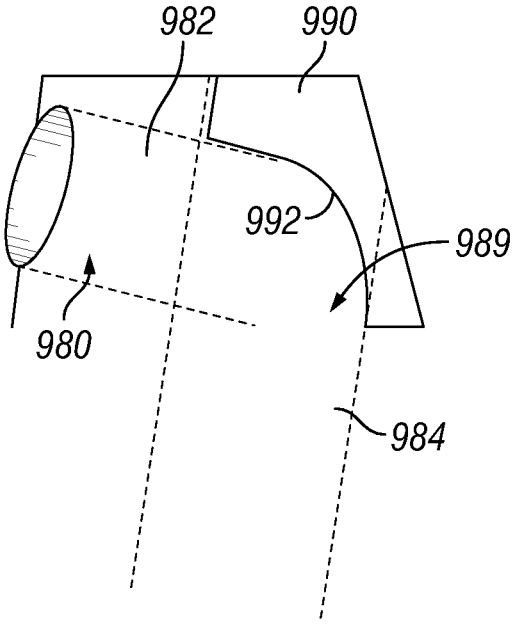
FIG. 9 shows an elevation view of a flowpath of a high angle nozzle formed within a bit body in accordance with another exemplary embodiment.

FIG. 9 shows an elevation view of a flowpath 989 of a high angle nozzle 980 formed within a bit body 300, 500, 600, 700 in accordance with another exemplary embodiment. Referring to FIG. 9, the flowpath 989 and the high angle nozzle 980 is similar to anyone of the previously described flowpaths 589 and high angle nozzles 580. High angle nozzle 980 includes a nozzle socket cavity 982 and a second hole 984 that intersects with the nozzle socket cavity 982. The plug 990 is shaped and dimensioned to cover up at least a portion of the second hole 984. At least a portion of an inner surface 992 of the plug 990 defines a portion of the flowpath 989 that transitions between the nozzle socket cavity 982 and the second hole 984. According to some exemplary embodiments, the inner surface 992 of the plug 990 is at least partially curved-shaped, thereby improving the turning of the drilling fluid from the flow direction along the second hole 984 from the plenum 410 (FIG. 4) to the outlet of the nozzle socket cavity 982 and reducing fluid erosion therein during drilling. The plug 990 is coupled to the drill bit 300, 500, 600, 700 over at least the second hole 984 using a threaded connection, welding, brazing, gluing, or some other suitable coupling mechanism, either a process or a mechanical attachment. The plug 990 is fabricated from steel, tungsten carbide, or any other suitable material. In certain exemplary embodiments, if the second hole 984 was machined through a blade, then the plug 990 is optionally further machined to add a cutter pocket or otherwise to match the geometry of the blade as desired. Hence, the desired geometry of the blade and/or facial geometry of the bit is maintained.

According to some exemplary embodiments, at least portions of the surface of the flowpaths 890, 990 are hardfaced. The interior of the flowpath 890, 990 closest to the plenum 410 (FIG. 4), and the interior of the nozzle socket cavity 882, 982 closest to the second hole 884, 984 are accessible for hardfacing prior to the plug 890, 990 being installed. Hardfacing is intended to reduce the amount of fluid erosion occurring within the flowpaths 890, 990 during drilling and is known to people having ordinary skill in the art having the benefit of the present disclosure.

Figure 10:
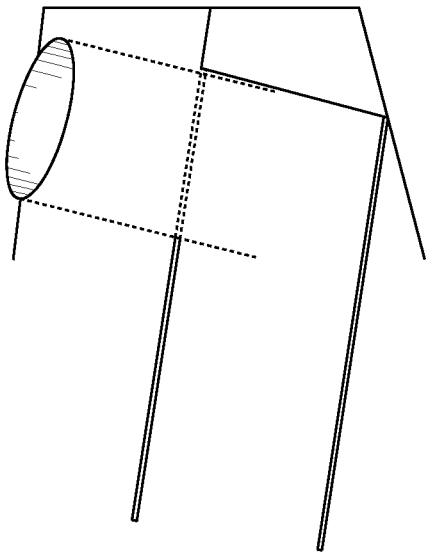
FIG. 10 shows an elevation view of a flowpath of a high angle nozzle formed within a bit body in accordance with another exemplary embodiment.

In yet other exemplary embodiments, an erosion resistant flow tube (not shown) (FIG. 10) is mounted within and through the second hole 884, 984. This flow tube is coupled within the second hole 884, 984 using glue, using the plug 890, 990 to hold it in place, or using some other suitable mechanism or adhesive. According to some exemplary embodiments, the geometry of the outlet end of the flow tube is configured to match the geometry of the inlet end of the nozzle socket cavity 882, 982.

Any bit or downhole tool using the method disclosed herein for installing one or more high angle nozzles is contemplated as being a part of the exemplary embodiments disclosed herein. These bits or downhole tools that are part of the exemplary embodiments disclosed herein may also include any other known features, such as standard linear nozzle passageways.

Exemplary embodiments of the invention provide the advantages of "lateral jets" or high angled nozzles in a machined steel body bit or other machined downhole tool. Exemplary embodiments of the invention further allows for the deployment of second holes through the base body, through the blades, or through both giving the bit designer the flexibility to place the second holes and high angle nozzle sockets in the optimal locations for bit cleaning. The exemplary embodiments of the invention offer solutions to erosion of the internal surfaces of the non-linear passageways.

Exemplary embodiments of this invention also is combinable with one or more "Flow Through" gauge features as disclosed within U.S. Non-Provisional patent application Ser. No. 14/034,634, entitled "Flow Through Gauge For Drill Bit" and filed on Sep. 24, 2013, and/or one or more "Flow Through" blade features as disclosed within U.S. Non-Provisional patent application Ser. No. 14/034,653, entitled "Blade Flow PDC Bits" and filed on Sep. 24, 2013, both of which have previously been hereby incorporated by reference herein.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A machined downhole tool, comprising:

a body made from steel and comprising a bit face at one end and a plenum formed therein and communicably coupled to an opening at an opposing end;

a blade extending outwardly from the body and comprising:

a leading edge section;

a trailing edge section;

a face section extending from a longitudinal end of the leading edge section to a longitudinal end of the trailing edge section; and an inner section extending from a latitudinal end of the leading edge section to a latitudinal end of the trailing edge section and from the bit face to a latitudinal end of the face section;

a high angle nozzle comprising:

a nozzle socket cavity machined into one of the leading edge section, the trailing edge section, and the inner section; and a second hole machined into a different one of the blade sections, intersecting with the nozzle socket cavity, and extending to the plenum, wherein the nozzle socket cavity and a second hole collectively form a fluid passage; and a plug coupled to the drill bit and covering the second hole, the plug comprising an inner surface defining at least a portion of the fluid passage and an outer surface matching a geometry of the blade.

2. The machined downhole tool of claim 1, wherein the nozzle socket cavity is machined into the inner section.

3. The machined downhole tool of claim 1, wherein the nozzle socket cavity is machined into the leading edge section.

4. The machined downhole tool of claim 1, wherein the nozzle socket cavity is machined into the trailing edge section.

5. The machined downhole tool of claim 1, wherein an angle is formed between the nozzle socket cavity and the second hole, the angle ranging from between about 60 degrees to about 145 degrees.

6. The machined downhole tool of claim 1, wherein an angle is formed between the nozzle socket cavity and the second hole, the angle ranging from between about 60 degrees to about 135 degrees.

7. The machined downhole tool of claim 1, wherein an angle is formed between the nozzle socket cavity and the second hole, the angle ranging from between about 60 degrees to about 120 degrees.

8. The machined downhole tool of claim 1, wherein the perimeter of the second hole is larger than the perimeter of the nozzle socket cavity.

9. The machined downhole tool of claim 1, wherein the inner surface comprises a curve-shaped portion.

10. The machined downhole tool of claim 1, wherein at least a portion of the fluid passage is hardfaced.

11. The machined downhole tool of claim 1, further comprising an erosion resistant flow tube mounted within the second hole.

12. A method for forming a high angle nozzle within a machined downhole tool, comprising:

obtaining a machined downhole tool, comprising:

a body made from steel and comprising a bit face at one end and a plenum formed therein and communicably coupled to an opening at an opposing end; and a blade extending outwardly from the body and comprising:

a leading edge section;

a trailing edge section;

a face section extending from a longitudinal end of the leading edge section to a longitudinal end of the trailing edge section; and an inner section extending from a latitudinal end of the leading edge section to a latitudinal end of the trailing edge section and from the bit face to a latitudinal end of the face section;

machining a nozzle socket cavity laterally or substantially laterally into one of the leading edge section, the trailing edge section, and the inner section;

machining a second hole longitudinally or substantially longitudinally into a different one of the blade sections, the second hole intersecting with the nozzle socket cavity and extending to the plenum, wherein the nozzle socket cavity and the second hole collectively form a fluid passage; and covering the second hole by coupling a plug to the machined downhole tool, the plug comprising an inner surface defining at least a portion of the fluid passage and an outer surface matching a geometry of the blade.

13. The method of claim 12, wherein an angle is formed between the nozzle socket cavity and the second hole, the angle ranging from between about 60 degrees to about 145 degrees.

14. The method of claim 12, wherein an angle is formed between the nozzle socket cavity and the second hole, the angle ranging from between about 60 degrees to about 135 degrees.

15. The method of claim 12, wherein an angle is formed between the nozzle socket cavity and the second hole, the angle ranging from between about 60 degrees to about 120 degrees.

16. The method of claim 12, wherein the perimeter of the second hole is larger than the perimeter of the nozzle socket cavity.

17. The method of claim 12, wherein the inner surface comprises a curve-shaped portion.

18. The method of claim 12, further comprising hardfacing at least a portion of the fluid passage.

19. The method of claim 12, further comprising coupling a flow tube to an inner surface of the second hole.

* * * * *